United States Patent [19]

Johnson et al.

[11] Patent Number: 4,966,225

[45] Date of Patent: Oct. 30, 1990

[54] CERAMIC SHELL MOLD FOR INVESTMENT CASTING AND METHOD OF MAKING THE SAME

[75] Inventors: Paul R. Johnson, Whitehall; Eliot S. Lassow, North Muskegon, both of Mich.

[73] Assignee: Howmet Corporation, Greenwich, Conn.

[21] Appl. No.: 512,502

[22] Filed: Apr. 20, 1990

Related U.S. Application Data

[63] Continuation of Ser. No. 205,731, Jun. 13, 1988, abandoned.

[51] Int. Cl.[5] ..... B22C 1/00; B22C 9/04

[52] U.S. Cl. ..... 164/519; 164/35; 164/361

[58] Field of Search ..... 164/516, 517, 518, 519, 164/361, 34, 35, 36

[56] References Cited

U.S. PATENT DOCUMENTS

| | | | |
|---|---|---|---|
| Re. 26,495 | 12/1968 | Watts et al. . | |
| 2,491,096 | 12/1949 | Feagin . | |
| 2,912,729 | 11/1959 | Webb . | |
| 2,932,864 | 4/1960 | Mellen, Jr. et al. . | |
| 3,077,648 | 2/1963 | Sutherland . | |
| 3,537,949 | 11/1970 | Brown et al. . | |
| 3,751,276 | 8/1973 | Beyer et al. . | |
| 3,752,689 | 8/1973 | Moore, Jr. . | |
| 3,859,153 | 1/1975 | Beyer et al. . | |
| 3,860,476 | 1/1975 | Moore, Jr. . | |
| 3,894,572 | 7/1975 | Moore, Jr. . | |
| 3,910,798 | 10/1975 | Shires et al. . | |
| 3,933,190 | 1/1976 | Fassler et al. . | |
| 3,994,346 | 11/1976 | Brown . | |
| 4,019,558 | 4/1977 | Szabo . | |
| 4,057,433 | 11/1977 | Brown . | |
| 4,063,954 | 12/1977 | Brown . | |
| 4,188,450 | 2/1980 | Greskovich . | |
| 4,196,769 | 4/1980 | Feagin . | |
| 4,244,551 | 1/1981 | Terkelsen et al. . | |
| 4,428,895 | 3/1984 | Blasch et al. . | |
| 4,552,800 | 11/1985 | Blasch et al. . | |
| 4,655,276 | 4/1987 | Bird et al. | 164/519 |

OTHER PUBLICATIONS

M. Hemma-Reddy and S. N. Tewari, "Processing Parameters Versus the Strength of Investment Casting Shell Moulds", Transactions of the Indian Institute of Metals, vol. 33, No. 3, Jun. 1980, pp. 250–253.

*Primary Examiner*—Kuang Y. Lin

*Attorney, Agent, or Firm*—Finnegan, Henderson, Farabow, Garrett & Dunner

[57] ABSTRACT

A ceramic shell mold and method of making the same. The ceramic shell mold includes a facecoat layer comprised of a first ceramic material. A plurality of alternating layers are formed overlaying the facecoat layer. The alternating layers are comprised of a second ceramic material and a third ceramic material, the third ceramic material having thermophysical properties different than the second ceramic material. The second ceramic material and the third ceramic material are preferably a zircon-based material and an alumina-based material, respectively. The resultant ceramic shell mold has a greater high temperature creep resistance than a shell mold formed solely from the second ceramic material or solely from the third ceramic material.

19 Claims, 1 Drawing Sheet

CERAMIC SHELL MOLD FOR INVESTMENT CASTING AND METHOD OF MAKING THE SAME

This application is a continuation of application Ser. No. 07/205,731, filed June 13, 1988, now abandoned.

FIELD OF THE INVENTION

The invention relates to investment casting and, more particularly, to a ceramic shell mold for investment casting high melting point metals and alloys and a method for forming the ceramic shell mold.

BACKGROUND OF THE INVENTION

In the investment casting of high melting point metals and alloys, silica bonded ceramic shell molds conventionally have been used to contain and shape the molten material Bulging and cracking of conventional silica bonded ceramic shell molds have been experienced in the investment casting of recently developed high melting point alloys at casting temperatures above 2700° F. because of the low flexural strength and low creep resistance of such shell molds at the higher casting temperatures. When the ceramic shell mold bulges, the dimensions of the resultant casting are not accurate. Significant cracking can result in failure of the ceramic shell mold and runout of the molten material.

To achieve better performance than conventional silica bonded ceramic shell molds provide at higher casting temperatures, ceramic shell molds having an alumina, mullite, or other highly refractory oxide bond have been used. These bond materials normally are incorporated into the shell molds via slurries or suspensions of the ceramic material. Ceramic shell molds bonded with highly refractory oxides, however, suffer from one or more of the following disadvantages. The required ceramic slurries typically are difficult to control with respect to suspension stability, viscosity, and drainage. Further, the slurry coatings are difficult to dry and cure. These shell molds must be fired to a high temperature to achieve adequate sintering or chemical bonding. The shell molds also may be too strong during post-cast cooling, thereby inducing hot tears and/or recrystallization in the cast metal. In addition, such shell molds can be too strong and chemically inert at room temperature to be easily removed from the casting.

Attempts also have been made to strengthen conventional silica bonded ceramic shell molds by reinforcing with a ceramic bracing network. Other efforts to overcome the inadequate high temperature properties of conventional silica bonded ceramic shell molds have focused on redesigning the part to be cast or changing the manner in which it is cast. These methods, however, are expensive, labor intensive, and, in most instances, impractical.

Accordingly, it is an object of the invention to provide a ceramic shell mold having improved mechanical properties at high temperatures.

Another objective of the invention is to provide a ceramic shell mold which facilitates improved control of casting dimensions and which can be easily removed from the casting.

A further objective of the invention is to provide a method for making a ceramic shell mold having improved mechanical properties at high temperatures.

Additional objects and advantages will be set forth in part in the description which follows, and in part, will be obvious from the description or may be learned by practice of the invention.

SUMMARY OF THE INVENTION

To achieve the foregoing objects in accordance with the purpose of the invention, as embodied and broadly described herein, the ceramic shell mold of the present invention includes a facecoat layer comprised of a first ceramic material. A plurality of alternating layers overlay the facecoat layer. The alternating layers are comprised of a second ceramic material and a third ceramic material, the third ceramic material having thermophysical properties different than the second ceramic material. If desired, a cover layer overlaying the alternating layers may be provided. The resultant ceramic shell mold has a greater high temperature creep resistance than a shell mold formed solely from the second ceramic material or solely from the third ceramic material.

In the method of the present invention for forming the ceramic shell mold, a pattern having the shape of the desired casting is provided. A facecoat layer is formed by applying a first ceramic material on the pattern, preferably by dipping the pattern into a slurry comprised of the first ceramic material. A plurality of alternating layers overlaying the facecoat layer then are formed. The alternating layers are formed by alternately applying a second ceramic material and a third ceramic material on the coated pattern, the third ceramic material having thermophysical properties different than the second ceramic material. In a preferred embodiment, the alternating layers are formed by alternately dipping the coated pattern into slurries comprised of the second ceramic material and the third ceramic material, respectively. Each dipping step is followed by the step of applying a ceramic stucco on the ceramic slurry layer and drying. If desired, the method may include the step of forming a cover layer overlaying the alternating layers.

DESCRIPTION OF THE PREFERRED EMBODIMENTS

Figure 1:
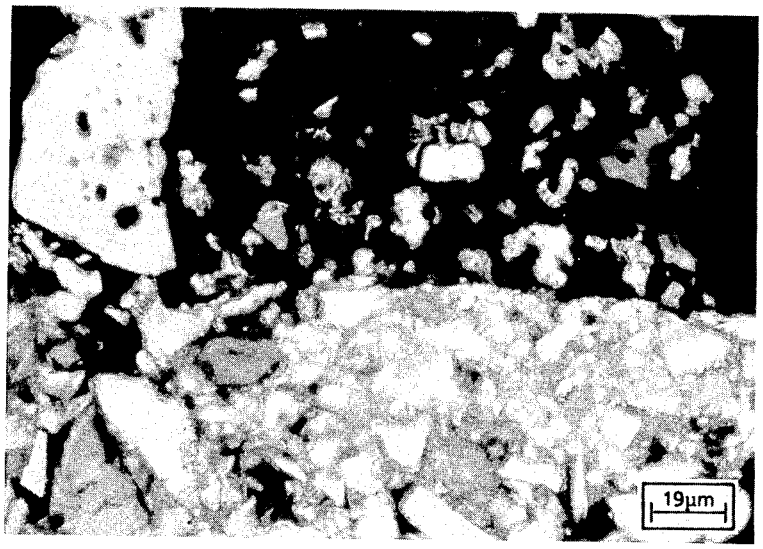
FIG. 1 is a transmitted light photomicrograph of the interface between an alumina-based layer and a zircon-based layer in a ceramic shell mold formed in accordance with the invention.

Reference will now be made in detail to the present preferred embodiments of the invention.

In accordance with the invention, a pattern having the shape of the desired casting is provided. The pattern may be made of wax, plastic, frozen mercury, or other materials suitable for use in "lost wax" casting processes.

A facecoat layer then is formed on the pattern by applying a first ceramic material. The ceramic material is preferably an alumina-based or zircon-based material. The facecoat layer preferably is formed by dipping the pattern into a first slurry comprised of the first ceramic material. After allowing excess slurry to drain from the coated pattern, ceramic stucco is applied. The ceramic stucco may be coarse alumina (120 mesh or coarser) or other suitable refractory material. The facecoat layer is allowed to dry prior to the application of additional layers.

In accordance with the invention, a plurality of alternating layers overlaying the facecoat layer are formed by alternately applying a second ceramic material and a third ceramic material on the coated pattern. As used in connection with the description of the invention, a sequence of "alternating" layers is any sequence of layers including at least one layer of the second ceramic material and at least one layer of the third ceramic material. Thus, where A represents the second ceramic material and B represents the third ceramic material, sequences of layers such as ABABAB, AAABAA, AABBAA, and BBBABB are all sequences of alternating layers.

The second and third ceramic materials are preferably applied by alternately dipping the coated pattern into a second ceramic slurry comprised of the second ceramic material and a third ceramic slurry comprised of the third ceramic material. Each dipping step is followed by the step of applying a ceramic stucco on the ceramic slurry layer and drying. While not preferred, it is possible to omit applying ceramic stucco on either the facecoat layer or any of the alternating layers.

In addition to-dipping in a slurry, the alternating layers, as well as the facecoat layer, may be applied by spray coating or flow coating. When the layers are applied by spray coating or flow coating, the ceramic slurry is thinned, if necessary, with an appropriate solvent to provide for suitable handling.

In accordance with the invention, the third ceramic material has thermophysical properties different than the second ceramic material A ceramic shell mold formed of alternating layers of ceramic materials having different thermophysical properties has better high temperature properties than a ceramic shell mold formed solely from either individual ceramic material. As used in connection with the description of the invention, "thermophysical properties" refer to the physical characteristics of a material at elevated temperatures. While not fully understood, it is believed that a mismatch in a physical characteristic such as strength or creep resistance between the alternating layers causes the shell mold to act as a composite material, with the layers of one material reinforcing the layers of the other material. Suitable materials having different thermophysical properties include, but are not limited to, alumina, mullite, zirconia, yttria, thoria, zircon, silica, an alumino-silicate containing less than 72 wt. % alumina, and compounds, mixtures, or solid solutions.

While not required, the ceramic material used to form the facecoat layer, previously referred to as the first ceramic material, may be substantially the same as either of the second or third ceramic materials used in forming the alternating layers. As used herein, ceramic materials that are "substantially the same" are ceramic materials that are identical or differ in that one ceramic material contains additional components that do not materially affect the properties of the other ceramic material.

In a preferred embodiment, the alternating layers are formed by alternately dipping the coated pattern into an alumina-based slurry containing a silica binder and a zircon-based slurry containing a silica binder. The number of alternating layers required for adequate shell mold build-up depends on the nature of the casting operation in which the shell mold is to be used. Examples of shell mold constructions for a nine-layer shell mold, where the alternating layers are formed from an alumina-based material (represented by A) and a zircon-based material (represented by Z), include: ZZZAZAZAZ, ZAZAZAZAZ, AZAZAZAZA, ZZAZZZZZZ, ZZZZZZZZA, ZAAZAAZAA, ZZAZZAZZA, ZZAZAZZZZ, ZZAZZZZAA, and ZZZAAAZZZ.

In a most preferred embodiment, seven alternating layers overlaying the facecoat layer are formed. The first, second, fourth, and sixth layers are formed by dipping the pattern into the zircon-based slurry. The third, fifth, and seventh layers are formed by dipping the pattern into the alumina-based slurry. As stated above, ceramic stucco is preferably applied after each dipping step.

If desired, a cover or seal layer may be formed overlaying the plurality of alternating layers. No stucco is applied to a cover layer. The cover layer may be formed of either the first, second, or third ceramic material, or a different ceramic material. A plurality of cover dips also may be applied.

Once the shell mold is built-up to the desired number of layers, it is thoroughly dried and the pattern is removed therefrom. Conventional techniques, such as melting, dissolution, and/or ignition may be used to remove the pattern from the shell mold. Following pattern removal, it is desirable to fire the shell mold at a temperature of approximately 1800° F. for approximately one hour in an oxidizing, reducing, or inert atmosphere.

At this point, the fired shell mold is ready for use in the investment casting of metals and alloys, including high melting point metals and alloys. Prior to casting, however, the shell mold may be preheated to a temperature in the range of 200° F. to 2800° F. to insure that it is effectively free from moisture and to promote good filling of the molten material in all locations of the shell mold.

Equiaxed, directionally solidified, and single crystal castings of high melting point alloys, in particular nickel-based superalloys, may be produced in accordance with conventional investment casting techniques using the ceramic shell mold of the invention. After the molten material has cooled, the casting, which assumes the shape of the original wax pattern, is removed and finished using conventional methods.

The principles of the present invention described broadly above will now be described with reference to specific examples.

EXAMPLE I

Mechanical property evaluations were conducted on ceramic shell molds of the invention and conventional shell molds. Shell plates (6 inches × 1 inch) were fabricated on wax patterns in accordance with conventional dipping and stuccoing techniques. The dip sequences utilized were as follows:

| | LAYER | | | | | | | |
|---|---|---|---|---|---|---|---|---|
| Shell Mold No. | 1 | 2 | 3 | 4 | 5 | 6 | 7 | Cover |
| 1 (conventional) | Z | Z | Z | Z | Z | Z | Z | Z |
| 2 (conventional) | A | A | A | A | A | A | A | A |
| 3 | Z | Z | Z | A | Z | A | Z | A |

A = alumina-based slurry
Z = zircon-based slurry

Following build-up, the shell molds were dried, dewaxed in a steam autoclave, and fired at 1850° F. for 1 hour in an air atmosphere. The shell molds then were trimmed to the desired test specimen size via diamond saw cutting. Four-point modulus of rupture (MOR) and cantilever slump (also known as creep or sag) were measured at 2800° F. in an air atmosphere for each shell mold. MOR testing was conducted on "flat," 3.45 inch×0.75 inch specimens loaded with a 1 inch upper span and a 2 inch lower span. The crosshead speed was 0.2 inch/minute. Slump testing was conducted on "flat," 5 inch×0.75 inch specimens, of which 1.5 inches of the specimen was held fixed and 3.5 inches of the specimen was unsupported (cantilevered) during the high temperature test exposure. The results of the MOR and slump testing at 2800° F. were as follows:

| Shell Mold No. | Average MOR (PSI) at 2800° F. | Average Slump (mm) at 2800° F. |
|---|---|---|
| 1 | 180 | 10.6 |
| 2 | 1100 | 12.4 |
| 3 | 370 | 6.0 |

As shown above, shell mold No. 3 having the alternating layer construction of the invention demonstrated higher strength than shell mold No. 1 (formed solely from zircon-based material), advantageously lower strength than shell mold No. 2 (formed solely from alumina-based material), and less slump than either shell mold No. 1 or No. 2. Such surprising slump performance results would not have been predicted via a rule-of-mixtures model. As can be seen in FIG. 1, which is a photomicrograph of the interface between an alumina-based layer and a zircon-based layer, there is no apparent reaction or new phase formation to account for the improvement in mechanical properties for the shell mold of the invention. This observation is further supported by x-ray diffraction analyses which revealed no now phase formation. In FIG. 1, the bottom half of the photomicrograph is the zircon-based layer. The top half is the alumina-based layer. The large white grain in the upper left hand corner is an alumina stucco grain.

EXAMPLE II

The following shell mold systems were tested in the manner described above in Example I:

| Shell Mold No. | LAYER 1 | 2 | 3 | 4 | 5 | 6 | 7 | 8 | Cover | Cover |
|---|---|---|---|---|---|---|---|---|---|---|
| 4 | Z | Z | A | Z | Z | Z | Z | Z | Z | — |
| 5 | Z | Z | A | Z | Z | Z | Z | Z | A | A |
| 6 | Z | Z | Z | A | Z | A | Z | A | Z | — |

A = alumina-based slurry
Z = zircon-based slurry

As can be seen below, the test results demonstrate the improved high temperature mechanical properties of shell molds encompassed by the invention.

| Shell Mold No. | Average MOR (PSI) at 2800° F. | Average Slump (mm) at 2800° F. |
|---|---|---|
| 4 | 480 | 3.5 |
| 5 | 540 | 1.9 |
| 6 | 780 | 2.8 |

EXAMPLE III

The following shell systems also were tested in the same manner described above in Example I:

| Shell Mold No. | LAYER 1 | 2 | 3 | 4 | 5 | 6 | 7 | 8 | Cover |
|---|---|---|---|---|---|---|---|---|---|
| 7 (conventional) | Z | Z | Z | Z | Z | Z | Z | Z | Z |
| 8 | A | A | Z | Z | Z | Z | Z | Z | Z |
| 9 | Z | A | Z | A | Z | A | Z | A | Z |
| 10 | Z | Z | A | A | Z | A | A | Z | A |
| 11 | A | A | Z | A | A | Z | A | A | Z |

A = alumina-based slurry
Z = zircon-based slurry

The tests results shown below further demonstrate the improved high temperature mechanical properties of shell molds of the present invention (shell mold Nos. 8, 9, 10, and 11) in comparison with conventional shell molds (shell mold No. 7).

| Shell Mold No. | Average MOR (PSI) at 2800° F. | Average Slump (mm) at 2800° F. |
|---|---|---|
| 7 | 180 | 9.4 |
| 8 | 270 | 2.8 |
| 9 | 380 | 3.4 |
| 10 | 1000 | 5.2 |
| 11 | 1600 | 7.3 |

The present invention has been disclosed in terms of preferred embodiments. The invention is not limited thereto and is defined by the appended claims and their equivalents.

What is claimed is:

1. A method for forming a ceramic shell mold for investment casting high point metals and alloys, said method comprising the steps of:

providing a pattern having the shape of a desired casting;

forming a facecoat layer by dipping said pattern into a first slurry comprised of a first ceramic material;

forming a first layer overlaying said facecoat layer by dipping the coated pattern into a second slurry comprised of a second ceramic material;

forming at least one intermediate layer overlapping said first layer by dipping the coated pattern into a ceramic slurry selected from the group consisting of said second slurry and a third slurry comprised of a third ceramic material, said third ceramic material having a composition different from said second ceramic material, at least one of said at least one intermediate layer being formed by dipping the coated pattern into said third slurry, said third ceramic material having different thermophysical properties than said second ceramic material such that said ceramic shell mold has a greater high temperature creep resistance than a shell mold formed solely from said second ceramic material or solely from said third ceramic material; and forming a layer overlaying said at least one intermediate layer by dipping the coated pattern into said second slurry.

2. The method of claim 1, wherein said second and third ceramic materials are selected from the group consisting of alumina, mullite, zirconia, yttria, thoria, zircon, silica, an alumino-silicate containing less than 72 wt. % alumina, and compounds, mixtures, or solid solutions thereof.

3. The method of claim 1, wherein the first and second ceramic materials are substantially the same.

4. The method of claim 1, wherein the first and third ceramic materials are substantially the same.

5. The method of claim 1, wherein the step of forming at least one intermediate layer includes the step of:

forming six intermediate layers overlaying said first layer, said first, third, and fifth intermediate layers being formed by dipping the coated pattern into a zircon-based slurry, said second, fourth, and sixth intermediate layers being formed by dipping the coated pattern into an alumina-based slurry.

6. A method for forming a ceramic shell mold for investment casting high melting point metals and alloys, said method comprising the steps of:

providing a pattern having the shape of a desired casting;

forming a facecoat layer by dipping said pattern into a ceramic slurry;

forming a first layer overlaying said facecoat layer by dipping the coated pattern into a slurry selected from the group consisting of alumina-based and zircon-based slurries;

forming at least one intermediate layer overlaying said first layer by dipping the coated pattern into a slurry selected from the group consisting of alumina-based and zircon-based slurries, at least one of said at least one intermediate layer being formed by dipping the coated pattern into the slurry not selected for forming said first layer; and forming a layer overlaying said at least one intermediate layer by dipping the coated pattern into the slurry selected for forming said first layer.

7. The method of claim 6, wherein the step of forming at least one intermediate layer includes the step of:

forming six intermediate layers overlaying said first layer, said first, third, and fifth intermediate layers being formed by dipping the coated pattern into a zircon-based slurry, said second, fourth, and sixth intermediate layers being formed by dipping the coated pattern into an alumina-based slurry.

8. A method for forming a ceramic shell mold for investment casting high melting point metals and alloys, said method comprising the steps of:

providing a pattern having the shape of a desired casting;

forming a facecoat layer by applying a first ceramic material;

forming a first layer overlayering said facecoat layer by applying a second ceramic material;

forming at least one intermediate layer overlaying said first layer by applying a ceramic material selected from the group consisting of said second ceramic material and a third ceramic material, said third ceramic material having a composition different from said second ceramic material, at least one of said at least one intermediate layer being formed by applying said third ceramic material, said third ceramic material having different thermophysical properties than said second ceramic material such that said ceramic shell mold has a greater high temperature creep resistance than a shell mold formed solely from said second ceramic material or solely from said third ceramic material; and forming a layer overlaying said at least one intermediate layer by applying said second ceramic material.

9. The method of claim 8, wherein said second and third ceramic materials are selected from the group consisting of alumina, mullite, zirconia, yttria, thoria, zircon, silica, an alumino-silicate containing less than 72 wt. % alumina, and compounds, mixtures, or solid solutions thereof.

10. The method of claim 8, wherein the first and second ceramic materials are substantially the same.

11. The method of claim 8, wherein the first and third ceramic materials are substantially the same.

12. The method of claim 8, wherein the step of forming at least one intermediate layer includes the step of:

forming six intermediate layers overlaying said first layer, said first, third, and fifth intermediate layers being formed by applying a zircon-based material, said second, fourth, and sixth intermediate layers being formed by applying an alumina-based slurry.

13. A ceramic shell mold for investment casting high melting point metals and alloys, said ceramic shell mold comprising:

a facecoat layer comprised of a first ceramic material, a first layer overlaying said facecoat layer comprised of a second ceramic material, at least one intermediate layer overlaying said first layer comprised of a material selected from the group consisting of said second ceramic material and a third ceramic material, said third ceramic material having a composition different from said second ceramic material, at least one of said at least one intermediate layer being comprised of said third ceramic material, said third ceramic material, having different thermophysical properties than said second ceramic material such that said ceramic shell mold has a greater high temperature creep resistance than a shell mold formed solely from said second ceramic material or solely from said third ceramic material; and a layer overlaying said at least one intermediate layer comprised of said second ceramic material.

14. The ceramic shell mold of claim 13, wherein said second and third ceramic materials are selected from the group consisting of alumina, mullite, zirconia, yttria, thoria, zircon, silica, an alumino-silicate containing less than 72 wt. % alumina, and compounds, mixtures or solid solutions thereof.

15. The ceramic shell mold of claim 13, wherein the first and second ceramic materials are substantially the same.

16. The ceramic shell mold of claim 13, wherein the first and third ceramic materials are substantially the same.

17. A ceramic shell mold for investment casting high melting point metals and alloys, said ceramic shell mold comprising:

a facecoat layer comprised of a ceramic material;

a first layer overlaying said facecoat layer comprised of a material selected from the group consisting of an alumina-based material and a zircon-based material;

at least one intermediate layer overlaying said first layer comprised of a material selected from the group consisting of an alumina-based material and a zircon-based material, at least one of said at least one intermediate layer being comprised of the material not selected for said first layer;

a layer overlaying said at least one intermediate layer comprised of the material selected for said first layer 18. The ceramic shell mold of claim 17, wherein said shell mold has six intermediate layers overlaying said first layer, said first, third, and fifth intermediate layers being comprised of a zircon-based material, said second, fourth, and sixth intermediate layers being comprised of an alumina-based material.

19. A ceramic shell mold for investment casting high melting point metals and alloys, said ceramic shell mold comprising:

a facecoat layer comprised of a ceramic material;

a first layer overlaying said facecoat layer comprised of a zircon-based material; and six layers overlaying said facecoat layer, said first, third, and fifth layers being comprised of a zircon-based material, said second, fourth, and sixth layers being comprised of an alumina-based material.

* * * * *